United States Patent [19]

Hopkins

[11] Patent Number: 4,502,304

[45] Date of Patent: Mar. 5, 1985

[54] FOAM APPLICATOR FOR WIDE FABRICS

[75] Inventor: Gregory J. Hopkins, Charlotte, N.C.

[73] Assignee: Dexter Chemical Corporation, New York, N.Y.

[21] Appl. No.: 605,870

[22] Filed: May 1, 1984

[51] Int. Cl.[3] ..... D06B 1/08

[52] U.S. Cl. ..... 68/200; 239/590.3

[58] Field of Search ..... 68/200, 205 R; 118/410, 118/411; 239/590, 590.3, 590.5, 597, 553.3, 553.5; 138/42; 137/602, 561 R; 15/306 A; 366/173

[56] References Cited

U.S. PATENT DOCUMENTS 4,402,200 9/1983 Clifford et al. ..... 68/200

FOREIGN PATENT DOCUMENTS 594415 3/1960 Canada ..... 239/597

2409544 9/1974 Fed. Rep. of Germany ... 239/590.3

OTHER PUBLICATIONS

PCT/US82/01471, Apr. 1983, 239/590.5.

*Primary Examiner*—Philip R. Coe

*Attorney, Agent, or Firm*—Curtis, Morris & Safford

[57] ABSTRACT

A foam applicator includes a pressure manifold having a pair of adjacent inner conduits and an outer conduit which surrounds the inner conduits. The inner conduits extend axially beyond the length of the outer conduit and are connected on both ends of each to a source of foam under pressure. The outer conduit has a slotted port formed therein which extends axially along a major portion of the length thereof. One inner conduit has an effluent port formed therein which extends over the central half thereof. The other inner conduit has effluent ports formed therein which extend over the end quarter portions thereof. Foam supplied to the inner conduits under pressure pass through the effluent ports formed in the inner conduits and is evenly distributed over the entire length of the outer conduit. The foam in the outer conduit passes through the slotted port of the outer conduit and is distributed onto a moving fabric passing in contact with the pressure manifold.

10 Claims, 4 Drawing Figures

FOAM APPLICATOR FOR WIDE FABRICS

BACKGROUND OF THE INVENTION

Field of the Invention

The present invention relates to a new and useful apparatus for the delivery of foam to textile fabrics and more particularly relates to a device for applying foam under pressure to a moving fabirc in an even manner so that consistent, high-quality foam finished or dyed fabrics are obtained.

In recent years and in particular since the advent of higher energy costs, much research effort has been devoted to the development of fabric finishing and dyeing apparatus which are more energy efficient than conventional finishing and dyeing devices. Conventional devices for finishing a fabric include a holding tank which contains a bath of finishing agent. A moving fabric is immersed in the bath and thereafter dried and further processed. The immersion of the fabric causes absorption of the finishing agent (dyestuff or sizing agent or the like) by the fibers of the moving fabric. This may result in the swelling and distortion of the fabric and the consequent weakening of the fibers. The conventional devices also have the substantial cost disadvantage of requiring substantial energy to remove the solution or dispersion liquid in which the finishing agent or dyestuff is contained.

Foam finishing apparatus, such as that described in U.S. Pat. No. 4,023,526, are used as alternatives to the conventional, immersion type fabric finishing devices. The advantage is that substantially less liquid per unit amount of finishing agent need be applied to and then removed from the fabric.

A device which is commonly used today and suitable for many foaming processes is referred to in the industry as a single knife applicator. This device includes basically a foam dam suspended above a moving fabric and a doctor blade mounted to the foam dam on the side thereof which is downstream with respect to the direction of fabric movement. A foam finish is contained within the foam dam which is in contact with a surface of the moving fabric. Foam is applied to the moving fabric and excess foam is scraped from the fabric by the doctor blade. The doctor blade causes a "foam bank" to build within the foam dam.

There are many inherent disadvantages in using the single knife applicator described above for applying foams to a moving fabric. One disadvantage is that it is difficult to closely control the exact amount of foam which is applied to the fabric. The foam bank is constantly changing in size and it is difficult to achieve a steady state operation. The operator of the device must control the height of the foam bank which is applied and maintained, the density of the foam (or its inverse, known as the blow ratio), the amount of liquid containing the foaming agent which is supplied to the applicator per unit time and the stability of the foam which is created, the latter being essentially a function of the choice and amount of surfactant which is used. The rate of absorption of the foam onto the moving fabric is determined by the wetting action of the foam as it contacts the moving fabric.

The problems associated with the single knife applicator have been essentially eliminated by the foam finishing apparatus disclosed in applicant's copending application Ser. No. 06/416,853, filed Sept. 13, 1982, which is herein incorporated by reference. The apparatus described in the above application includes a pressure manifold for applying foam under pressure to a moving fabric in contact therewith. The pressure manifold includes at least two conduits, an inner conduit to which foam is supplied under pressure having formed therein an effluent port extending over at least a portion of its length and an outer conduit, larger than the inner conduit and surrounding the inner conduit, the outer conduit having a slotted port formed along its length for delivery of foam under pressure to the moving fabric.

The present application discloses an alternative structure for a pressure manifold for a foam applicator to that which is described in the copending application Ser. No. 06/416,853. The invention is particularly useful in applying a foaming agent to wide fabrics where constant and uniform distribution of foam over the entire width of the fabric is required.

OBJECTS AND SUMMARY OF THE INVENTION

It is an object of the present invention to provide an apparatus for supplying foam to a moving fabric which avoids the problems of conventional foam applicators or immersion type applicators.

It is another object of this invention to provide an apparatus for supplying foam to a moving fabric which delivers the foam in a uniform amount per unit time to a moving fabric.

It is a further object of this invention to provide a foam apparatus which includes a manifold which is particularly well suited for applying foam under pressure to wide fabrics.

It is a further related object of this invention to disclose a foam applicator which provides sufficient operator control of the parameters so that fabrics of varying thicknesses and characteristics can be dyed or finished exactly as desired.

There and other objects of the invention are achieved in a foam applicator which includes a pressure manifold having at least two adjacent inner conduits which are connected to a supply of foam under pressure and an outer conduit surrounding the inner conduits. One of the inner conduits has a slot formed along the central portion of its axial length. The other inner conduit has two slots formed along the quarter end portions of its axial length. Thus, the inner conduits provide foam to specific areas of the interior of the outer conduit thereby distributing the foam more evenly over the entire length of the pressure manifold. The outer conduit also has a slotted port formed along its axial length. The pressure manifold is positioned to contact a moving fabric and uniformly delivers foam under pressure to the fabric through the slotted port of the outer conduit.

The above and other objects, features and advantages of this invention will be apparent in the following detailed description of illustrative embodiments thereof, which are to be read in connection with the accompanying drawings.

DETAILED DESCRIPTION OF THE PREFERRED EMBODIMENTS

Figure 1:
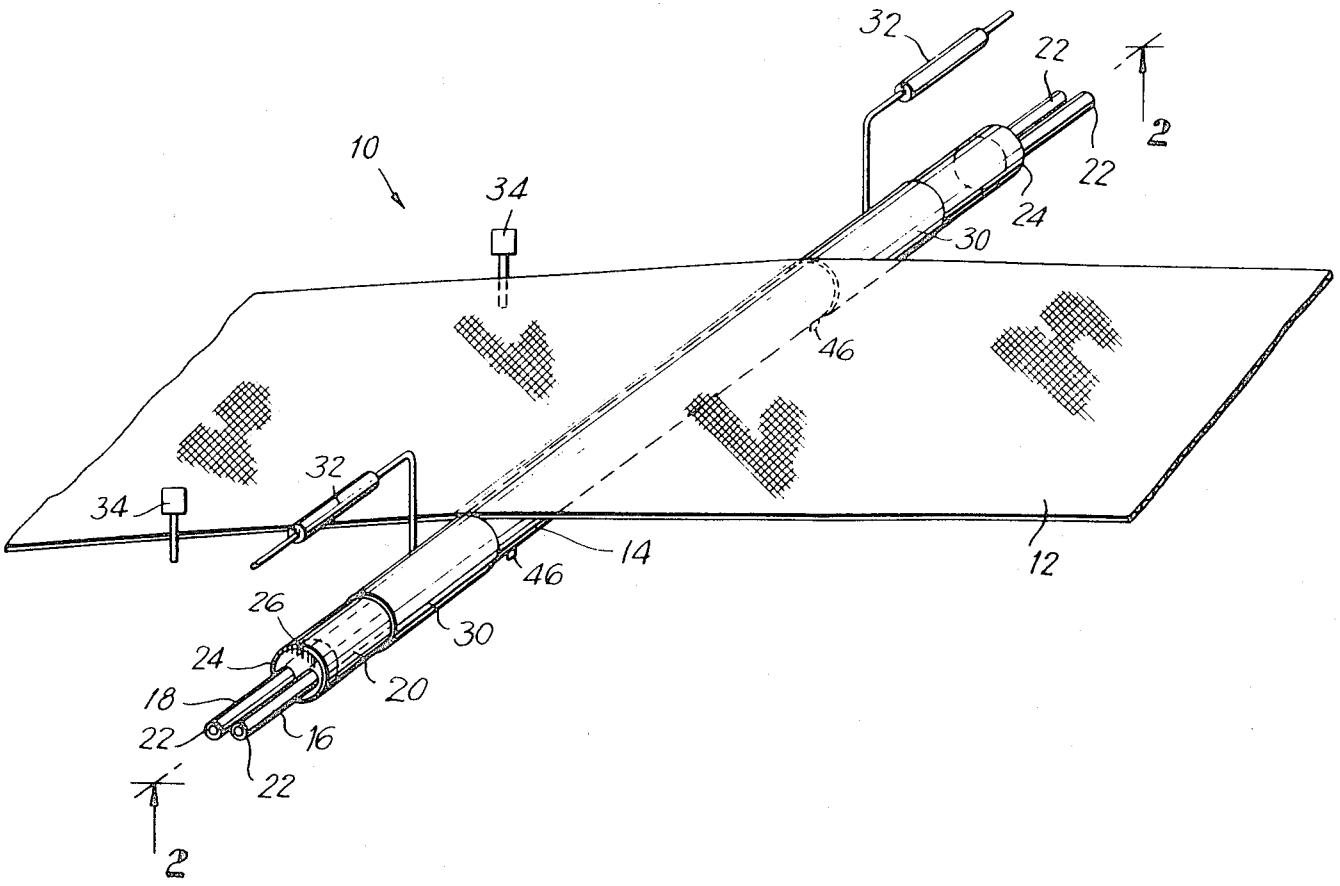
FIG. 1 is a perspective view of the foam applicator according to the present invention.
Figure 2:
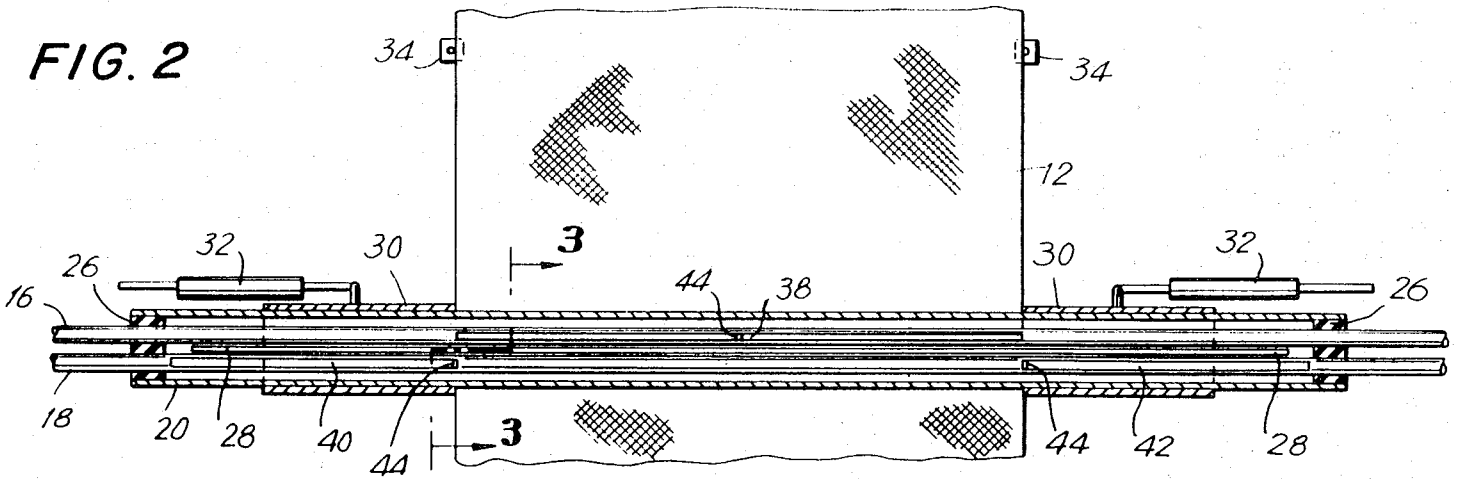
FIG. 2 is a sectional view of the foam applicator shown in FIG. 1 taken along lines 2—2 of FIG. 1.
Figure 3:
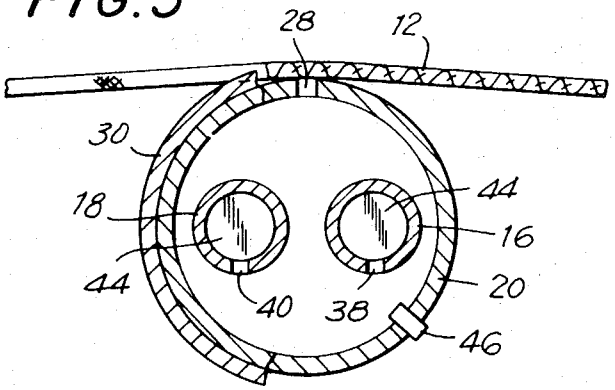
FIG. 3 is a sectional view of the foam applicator shown in FIG. 1 taken along lines 3—3 of FIG. 2.

Referring now to the drawings in detail and to FIGS. 1 through 3 thereof, reference numeral 10 refers generally to a foam applicator according to the present invention which applies a finish or dye in the form of a foam under pressure to a moving fabric 12 which passes in contact with the foam applicator. The applicator is preferably situated across the width of the moving fabric. To move the fabric relative to the foam applicator, conventional means, such as rollers (not shown), may be provided.

The foam applicator 10 includes a pressure manifold 14 having adjacent first and second inner conduits, designated by reference numerals 16 and 18 respectively, and an outer conduit 20 surrounding the inner conduits. Although only two inner conduits 16, 18 are shown in the drawings and described herein, it is envisioned that in accordance with the present invention a greater number of inner conduits may be used.

Foam containing a finishing agent, dye or the like, may be supplied to either ends 22 of the inner conduits 16, 18 and is desirably supplied by means of a positive displacement pump (not shown) to both ends of each inner conduit 16, 18. To facilitate their connection to the source of foam, the ends 22 of each inner conduit preferably extend axially beyond the ends 24 of the outer conduit 20. Fixed end seals 26 are included to seal the ends 24 of the outer conduit.

The outer conduit 20 of the pressure manifold which surrounds the inner conduits 16, 18 has formed along a portion of the axial length thereof a slotted port 28 through which foam is delivered under pressure to the moving fabric 12. The inner conduits 16, 18 are also slotted over portions thereof as will be described in more detail later. Both the inner and outer conduits are preferably made from polyvinyl chloride or stainless steel although other materials may be suitable.

Inwardly of the fixed end seals 26 are situated adjustable seals 30 which are preferably sleeves concentrically disposed about the outer conduit 20 and movable by pneumatic cylinders 32 or the like in the direction of the axis of the outer conduit. The adjustable seals 30 aere positioned over portions of the slotted portion 28 which extend beyond the width of the moving fabric. Thus, the pressure manifold of the present invention can adapt to fabrics of various widths by adjusting the effective length of the slotted port 28.

The foam applicator may further include palm sensors 34 which sense the position of the outer edges or the selvages 36 of the fabric as it passes before the pressure manifold. The palm sensors 34, as is well understood in the art, are provided with means for developing a signal which is a function of the position of the edge of the fabric. The pneumatic cylinders 32 respond to this signal and adjust the position of the sleeves 30.

As previously mentioned, the inner conduits 16, 18 are preferably slotted over portions thereof to evenly distribute the foam over the interior area of the outer conduit. Each inner conduit may have one or more slots formed therein. The slots of one conduit are offset in the axial direction from those of the other to supply foam to different areas of the outer conduit.

According to a preferred embodiment of the present invention, formed in the first inner conduit 16 and extending over a central portion thereof is a slotted effluent port 38. In the second inner conduit 18 are formed two effluent ports 40 and 42, each of which extends over the opposite end portions of conduit 18. Preferably, effluent port 38 extends over the central half of conduit 16 and ports 40, 42 extend over the end quarter portions of conduit 18 so that foam is supplied to the outer conduit 20 over its entire length. The length of ports 38, 40, 42 mentioned above relate, of course, only to the length of the inner conduits enclosed within the outer conduit and not to those portions of the inner conduits which extend from the ends of the outer conduit.

Partitions 44 may be provided in the inner conduits 16, 18. These partitions inhibit the flow of foam within the inner conduits to further ensure that the foam is uniformly distributed throughout the interior of the outer conduit 20. One partition 44 is positioned in inner conduit 16 to divide the centrally located slot 38 in half. Two partitions 44 are preferably provided in inner conduit 18 and positioned at the interior ends of the effluent ports 40, 42 formed in the corner end portions of the conduit.

The inner conduits 16, 18 are preferably arranged so that their ports are oriented in the same direction but 180° opposite the slotted port 28 formed in the outer conduit 20 although this particular orientation is not necessary to provide an even distribution of foam to the moving fabric. It has been found that as long as the slotted port of the outer conduit and the effluent slots of the inner conduits are not oriented in the same direction, the foam will be evenly distributed on the fabric.

The pressure manifold of the foam applicator according to the present invention may further be provided with means for sensing the distribution of foam within the interior of the outer conduit. The foam sensing means may include two or more pressure transducers 46 which are equally spaced along the length of the pressure manifold. Preferably a transducer 46 is situated where the ends of the slot 38 formed in the inner conduit 16 are adjacent an end of each slot 40, 42 formed in the second inner conduit 18. Stated another way, the transducers 46 are set inwardly from each end of the outer conduit 20 by a quarter length thereof.

The pressure transducers 46 are preferably mounted on the outer conduit 20 through holes 48 so that they can respond to the pressure of the foam contained within the interior of the outer conduit 20. Transducers 46 may be connected to an alarm circuit or other monitoring device (not shown) to determine if there is a proper distribution of foam throughout the length of the pressure manifold.

The foam applicator may further be provided with valves (not shown) to adjust the distribution of the foam within the interior of the outer conduit, either manually or automatically, in response to signals from the pressure monitoring device. The valves would be connected in line with conduits supplying foam under pressure to the ends of the inner conduits. An alternative arrangement which is envisioned is that the transducers 46 provide a visual indication of the foam pressure within the manifold, such as on a gauge. An operator monitoring the gauge may accordingly adjust the pressure valves to provide an even distribution of foam over the length of the manifold.

Figure 4:
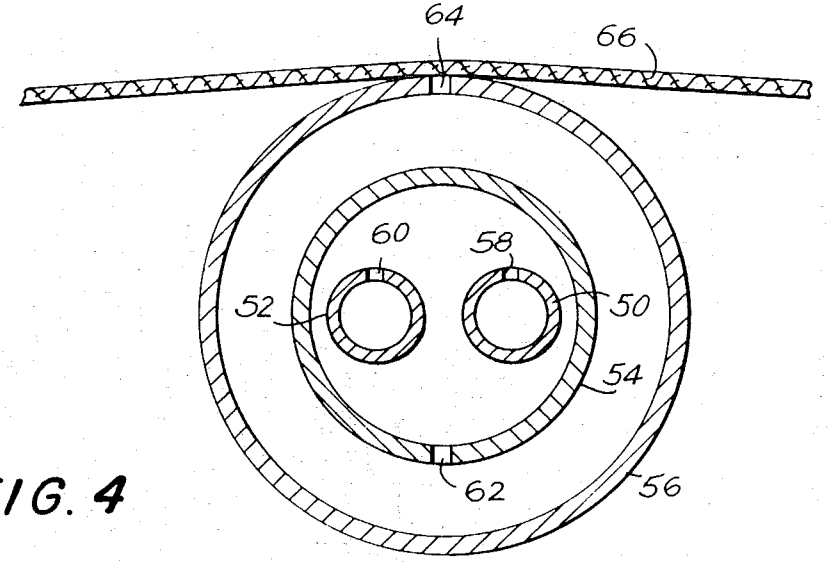
FIG. 4 is a sectional view taken through a central portion of an alternative embodiment of the foam applicator in accordance with the present invention.

The most preferred embodiment of the pressure manifold for the foam applicator according to the present invention is shown in FIG. 4 of the drawings. The embodiment shown in FIG. 4 in cross-section includes first and second adjacent inner conduits, 50 and 52 respectively, surrounded by a third conduit 54. The third conduit 54 is, in turn, surrounded by a fourth outer conduit 56. The first, second and third conduits have effluent ports 58, 60 and 62 respectively, formed therein in much the same way as the embodiment shown in FIGS. 1 through 3 of the drawings. The outermost conduit 56 has a slotted port 64 formed therein for distribution of the foam under pressure to a moving fabric 66 in contact with the pressure manifold. The remaining structure of the embodiment shown in FIG. 4 of the drawings is similar to that which was previously described in relation to FIGS. 1 through 3 and need not be repeated here.

The four conduit manifold is advantageous over the three conduit embodiment already discussed because it further aids in evenly distributing the foam throughout the length of the pressure manifold. When a bank of foam is separated into streams of foam, as by passing it through a number of openings, it is difficult to reunite the foam streams into a foam bank. For this reason a slotted port is formed in the outermost conduit of the manifold as opposed to a plurality of small openings. The third conduit 54 insures that the streams of foam passing through the effluent ports 58, 60 properly recombine before the foam is distributed on the fabric. The foam streams will fill the interior of the third conduit 54 and will pass through its effluent port 62. This helps mix the foam before it reaches the outermost conduit 56 and passes through the slotted port 64 onto the fabric. Furthermore, the two inner conduits 50, 52 and the third surrounding conduit 54 act as restriction orifices which supply foam at a high and uniform pressure over the entire length of the pressure manifold.

It has been found that the foam applicator described herein and shown in FIGS. 1 through 4 of the drawings is particularly well suited for use with extra wide fabrics, such as those which are 60–120 inches in width. In addition, the foam applicator is quite useful in applying either a foam finish or a foam pigment for dyeing the fabric. The valves of the foam applicator allow the foam to be adjustably distributed throughout the interior of the outer conduit. The distribution is easily monitorable with the pressure transducers mounted on the outer conduit.

The preferred four conduit pressure manifold includes inner conduits which are 0.75 inches in diameter and which have effluent ports that are 0.015 inches in width. The third conduit is $2\frac{1}{2}$ inches in diameter with a port of 0.025 to 0.03 inches in width. The fourth outermost conduit is 4 inches in diameter and includes a slotted port which is 0.125 inches in width.

The pressure manifold will work equally as well positioned on either side of the moving fabric. For best results, the fabric should wrap around the pressure manifold at least a small amount so that it seals the slotted port of the outer conduit and builds up the pressure of the foam inside the manifold. When the pressure of the foam inside the manifold exceeds the sealing force exerted by the fabric, the foam will be forced out of the manifold and will be absorbed at a uniform rate by the moving fabric.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of this invention.

What is claimed is:

1. A pressure manifold of a foam applicator for delivery of foam to a moving fabric, which includes:

at least one pair of parallel, inner conduits communicating at at least one end of each with a source of foam under pressure, each of the inner conduits having formed therein at least one effluent port extending along a portion of the length thereof, the effluent port of one inner conduit being offset axially from that of the other to distribute the foam evenly along the length of the pressure manifold; and an outer conduit having a diameter which is greater than the combined diameters of the inner conduits and surrouding the inner conduits, the outer conduit having formed therein a slotted port extending along a portion of the length thereof for delivery of foam under pressure to a moving fabric passing across the slotted port.

2. A pressure manifold of a foam applicator for delivery of foam to a moving fabric, which includes:

first and second parallel, inner conduits communicating at at least one end of each with a source of foam under pressure, the first inner conduit having formed therein an effluent port which extends over a central portion thereof and the second inner conduit having formed therein a pair of effluent ports which extend over opposite end portions thereof to distribute foam evenly along the length of the pressure manifold; and an outer conduit having a diameter which is greater than the combined diameters of the inner conduits and surrounding the inner conduits, the outer conduit having formed therein a slotted port extending along the length thereof for delivery of foam under pressure to a moving fabric passing across the slotted port.

3. A pressure manifold as defined in claim 2 wherein the effluent port formed in the first inner conduit extends over the central half of the first inner conduit and the effluent ports formed in the second inner conduit extend over the end quarter portions of the second inner conduit.

4. A pressure manifold as defined in claim 3 wherein each of the first and second inner conduits includes at least one partition which substantially inhibits the flow of foam through its respective inner conduit.

5. A pressure manifold as defined in claim 3 wherein the first inner conduit includes a partition which is situated substantially at the center of the effluent port formed therein and wherein the second inner conduit includes two partitions which are substantially situated at the interior ends of the effluent ports formed therein.

6. A pressure manifold as defined in claim 2 which further includes means for sensing the distribution of foam within the outer conduit.

7. A pressure manifold as defined in claim 6 wherein the foam distribution sensing means includes a plurality of pressure transducers spaced at equal distances along the length of the pressure manifold.

8. A pressure manifold as defined in claim 6 wherein the foam distribution sensing means includes at least two pressure transducers which are mounted to the outer conduit of the pressure manifold and situated near the interior ends of the effluent ports formed in the second inner conduit.

9. A pressure manifold of a foam applicator for delivery of foam to a moving fabric, which includes:

first and second parallel, inner conduits communicating at at least one end of each with a source of foam under pressure, the first inner conduit having formed therein an effluent port which extends over the central half thereof and the second inner conduit having formed therein a pair of effluent ports which extend over opposite end quarter portions thereof;

a third conduit having a diameter which is greater than the combined diameters of the inner conduits and surrounding the inner conduits, the third conduit having formed therein an effluent port extending along the length thereof; and a fourth conduit surrounding the third conduit and having formed therein a slotted port extending along the length thereof for delivery of foam under pressure to a moving fabric passing across the slotted part.

10. A pressure manifold as defined in claim 9 which further includes pressure transducers which are mounted to the fourth conduit of the pressure manifold to sense the distribution of foam within the fourth conduit.

* * * * *